United States Patent [19]

Repski

[11] Patent Number: 4,482,021

[45] Date of Patent: Nov. 13, 1984

[54] SOIL SAMPLER

[76] Inventor: Roman Repski, P.O. Box 930, Vegreville, Alberta, Canada, T0B 4L0

[21] Appl. No.: 415,377

[22] Filed: Sep. 7, 1982

[51] Int. Cl.[3] ..... E21B 49/02

[52] U.S. Cl. ..... 175/209

[58] Field of Search ..... 175/58, 209–211; 173/22, 23; 172/21, 22; 73/864.43, 864.44, 864.45

[56] References Cited

U.S. PATENT DOCUMENTS

| | | | |
|---|---|---|---|
| Re. 28,127 | 8/1974 | Derry | 175/209 |
| 2,084,686 | 6/1937 | Howard | 175/210 |
| 2,838,282 | 6/1958 | Colquitt | 175/211 |
| 3,190,370 | 6/1965 | Kvello-Aune et al. | 175/23 |
| 3,464,504 | 9/1969 | Stange | 175/58 |
| 3,593,807 | 7/1971 | Derry | 175/209 |

FOREIGN PATENT DOCUMENTS

| | | |
|---|---|---|
| 623475 | 10/1961 | Canada . |
| 654906 | 5/1963 | Canada . |

*Primary Examiner*—William F. Pate, III
*Assistant Examiner*—Mark J. DelSignore
*Attorney, Agent, or Firm*—A. W. Breiner

[57] ABSTRACT

A novel soil sampling device preferably mounted on a truck is provided herein. It includes five interrelated elements. The first is an upper hydraulic cylinder provided with a casing and rod movable from the casing, the casing thereof being anchored. The second element is a rotary motor fixedly mounted at the end of the rod of the hydraulic cylinder and adapted for vertical movement relative to the anchored casing of the hydraulic cylinder together with the rod of the hydraulic cylinder. The third element is an auger secured to, and rotably driven by, the motor, the motor and the auger being cooperatively vertically movable by the rod between an inoperative position, in which the auger is out of contact with the soil, and an operative position, in which the auger passes through, and a predetermined distance into, the soil. The fourth element is a lower soil sample box, positioned below the rotary motor, and mounted to the rod of the hydraulic cylinder at a location above the rotary motor, for vertical movement with respect to the anchored casing of the hydraulic cylinder. The soil sample box includes a pair of vertically aligned apertures therethrough for the passage of the auger therethrough. The soil sample box is also vertically movable between an inoperative position out of contact with the soil and an operative position resting atop the soil. Finally, guides are provided to guide the rotary motor and the auger for the above specified vertical movement. This provides an automatic truck-mounted soil sampling unit which easily and simply takes soil samples.

10 Claims, 6 Drawing Figures

SOIL SAMPLER

BACKGROUND OF THE INVENTION (1) Field of the Invention

This invention relates to soil sampling equipment.

It is frequently desirable to obtain samples of soils in various areas and at varying depths for analysis. In most operations in which the soil sample is required, speed and convenience in obtaining the sample whereby a large number of samples may be obtained in a short period of time are prime factors.

(2) Description of the Prior Art

In investigations of the distribution, type and physical properties of the soil below ground surface level, it is often desirable to be able to extract continuous, preferably undisturbed, samples of soil. The sampling method of sub-surface exploration provides practically continuous and representative samples of the sub-soil and is probably the best method yet devised for obtaining detailed and reliable information on the chracteristics of the sub-soil. A common and efficient type of sampler is the drive sampler which consists essentially of a tube which is advanced into the soil in the axial direction. There are various types of drive samplers in general use and these may be broadly classified in two groups, namely, open samplers and piston samplers. In the case of open samplers, the tube is always open at the lower end; the soil enters the tube as soon as it is forced into the ground. With piston samplers, on the other hand, the lower end of the tube is temporarily sealed, as by a piston or a plug, so that soil can be prevented from entering the sampler until it has been driven into the soil to the desired sampling depth. At that depth, the piston is released or retracted so that further advance of the sample into the soil forces a sample into the lower end of the tube.

Canadian Pat. No. 623,475 issued July 11, 1961 to P. J. Parsons provided a soil sampling device comprising a tubular drill rod having at least one soil sample-receiving opening in the side wall thereof, a piston assembly in the drill rod and having a pair of spaced connected pistons providing a soil sample-receiving chamber therebetween. It also included an axially extending tie bar connected to the piston assembly. The piston assembly was reciprocally mounted in the drill rod for closure of the opening by a selected one of the pistons.

Canadian Pat. No. 654,906 issued Jan. 1, 1963 to A. G. L. Andersson provided soil sampling equipment of the retracted-piston type which could be operated by means of a single line of extensions, thereby materially reducing the advancing and withdrawal time. Such equipment consisted of the combination of a tubular housing, a sample tube detachably connected at its upper end to the housing and formed at its lower end with a cutting edge, and a piston slidably mounted within the sample tube and adapted to seal off the lower end thereof. A piston rod was connected to the upper end of the piston and extended upwardly through the sample tube and the housing, the piston rod being formed at its upper end with an enlarged head portion adapted with the piston in its fully extended position, to engage the upper edge of the housing, so that downward pressure applied to the upper end of the rod would be transmitted to both the housing and the piston. A plurality of arcuate lugs were on the rod and were spaced apart longitudinally thereof. A plurality of arcuate segments were formed on the inner surface of the housing and were likewise spaced apart longitudinally thereof. The lugs and the segments were adapted to cooperate releasably to lock the rod and the housing in downwardly drivable engagement upon partial retraction of the piston through the sample tube, and in upwardly drivable engagement upon further retraction of the piston to its fully retracted position. A plurality of stop members were provided on the inner surface of the housing intermediate of the arcuate segments, the stop members cooperating with the arcuate lugs to limit the rotational movement of the rod relative to the housing, thereby to facilitate alignment of the lugs and the segments for intercoupling the rod and the housing. Vent means were provided between the piston and the inner surface of the sample tube effective with the piston in its partially retracted position to vent the section of the sample tube below the piston. Finally, means were associated with the piston and were adapted, upon movement of the piston upwardly from its partially retracted position, to seal off the vent means so that during the further retraction of the piston in its fully retracted position, a vacuum would be created above a soil sample which was forced into the sample tube upon downward movement of the housing after the initial partial retraction of the piston.

SUMMARY OF THE INVENTION

Aims of the Invention

Yet these two soil sampling devices still left much to be desired in the way of simplicity and speed of operation. Accordingly, it is an object of this invention to provide a soil sampling device which is of simple structure, and which has improved efficiency and speed of operation.

Another object of this invention is to provide such a soil sampling device which is suitable for use in practically all types of soil.

A still further object of the invention to provide a sampler which is of simple, yet robust, construction and which has no delicate parts liable to malfunction under exacting field conditions.

A further object of this invention is to provide such a soil sampler which can be mounted on a pick-up truck through means of a universal mounting bracket connection to the existing stake pockets of such pick-up truck.

Still another object of this invention is to provide such a soil sampler which is hydraulically powered but which can be operated from a 12-volt battery.

Yet another object of this invention is to provide such a soil sampler which includes a soil sampling auger which has replaceable plated steel bits, which may be threaded or pinned to the drive shaft for a positive, yet easily changed connection, which preferably includes a safety shear pin to eliminate auger damage, and which also preferably includes an auger cleaner for sub-normal soil conditions.

A still further object of this invention is to provide such a soil sampler which includes a removable sample container.

A still further object of this invention is to provide such a soil sampler including a specially designed probe to remove any type of soil with speed and ease.

Statements of Invention

By an embodiment of this invention, a soil sample device is provided comprising: (a) an upper hydraulic cylinder provided with a casing and a rod movable from the casing, the casing being anchored; (b) a rotary motor fixedly mounted at the end of the rod of the hydraulic cylinder and adapted for controlled movement relative to the anchored casing of the hydraulic cylinder together with the rod of the hydraulic cylinder; (c) an auger secured to, and rotatably driven by, the motor, the motor and the auger being cooperatively vertically movable by the rod between an inoperative position, in which the auger is out of contact with the soil, and an operative position in which the auger passes through, and a predetermined distance into, the soil; (d) a lower soil sample box positioned below the motor and mounted to the rod of the hydraulic cylinder at a location above the rotary motor for vertical movement with respect to the anchored casing of the hydraulic cylinder, the soil sample box including a pair of vertically aligned apertures therethrough for the passage of the auger therethrough, the soil sample box being vertically movable between a rest position out of contact with the soil and an operative position positioned atop the soil; and (e) guide means to guide the rotary motor and the auger for the above specified vertical movement.

Other Features of the Invention

By one feature thereof, the soil sample box includes a fixed component comprising a top wall and a front wall secured to the guide means, and a removable component including a bottom wall, two opposed side walls and a rear wall, for selective removal from the fixed component when the soil sample box contains soil sample, and when the auger is in its inoperative position.

By another feature thereof, the bottom wall includes a bottom aperture surrounded by a cylinder, whereby to retain soil sample in such box.

By a further feature thereof, the casing of the hydraulic cylinder is also provided with a pair of lower, spaced-apart, fixed guide rods.

By another feature, the rotary motor is provided with a casing, the casing being captured within a cage having hollow guide tubes encasing the guide rods.

By a further feature, the auger is pinned to the drive shaft by at least one shear pin.

By yet another feature, the soil sample box is secured a fixed distance below the cage to upstanding rods, each of which being secured, at its upper end to a yoke which itself is secured to the rod end of the hydraulic cylinder, a predetermined fixed distance above the cage.

By a further feature, the upstanding rods are slidable within guide sleeves secured to the casing of the hydraulic cylinder.

By yet a further feature, the soil sample device is mounted on a pick-up truck by means of a universal mounting comprising: (i) a first arm extending along the longitudinal length of the bed of the truck; and (ii) a second arm extending along the transverse width of the bed of the truck.

By another feature, the arms are angle irons.

BRIEF DESCRIPTION OF THE DRAWINGS

In the accompanying drawings

DESCRIPTION OF PREFERRED EMBODIMENTS

Description of FIGS. 1–4

Figure 1:
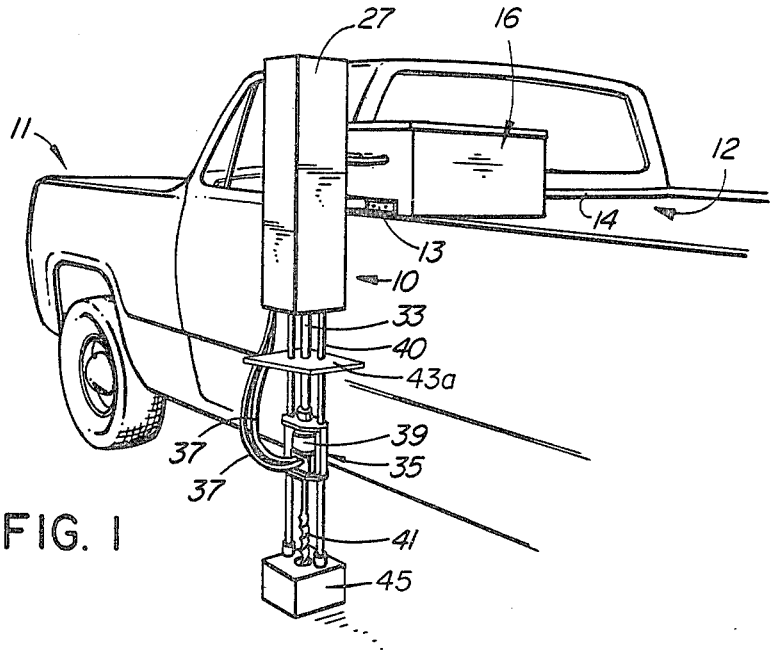
FIG. 1 is a perspective view of the soil sampling device of one aspect of this invention.
Figure 3:
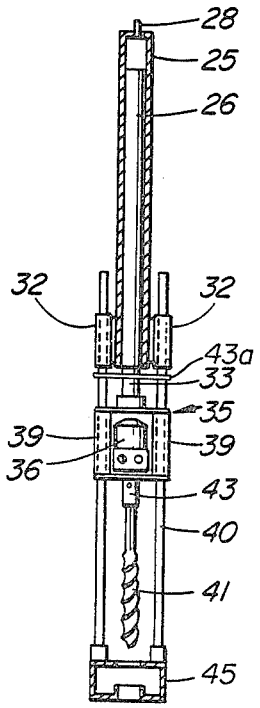
FIG. 3 is a vertical cross-section of the aspect of FIG. 1.
Figure 2:
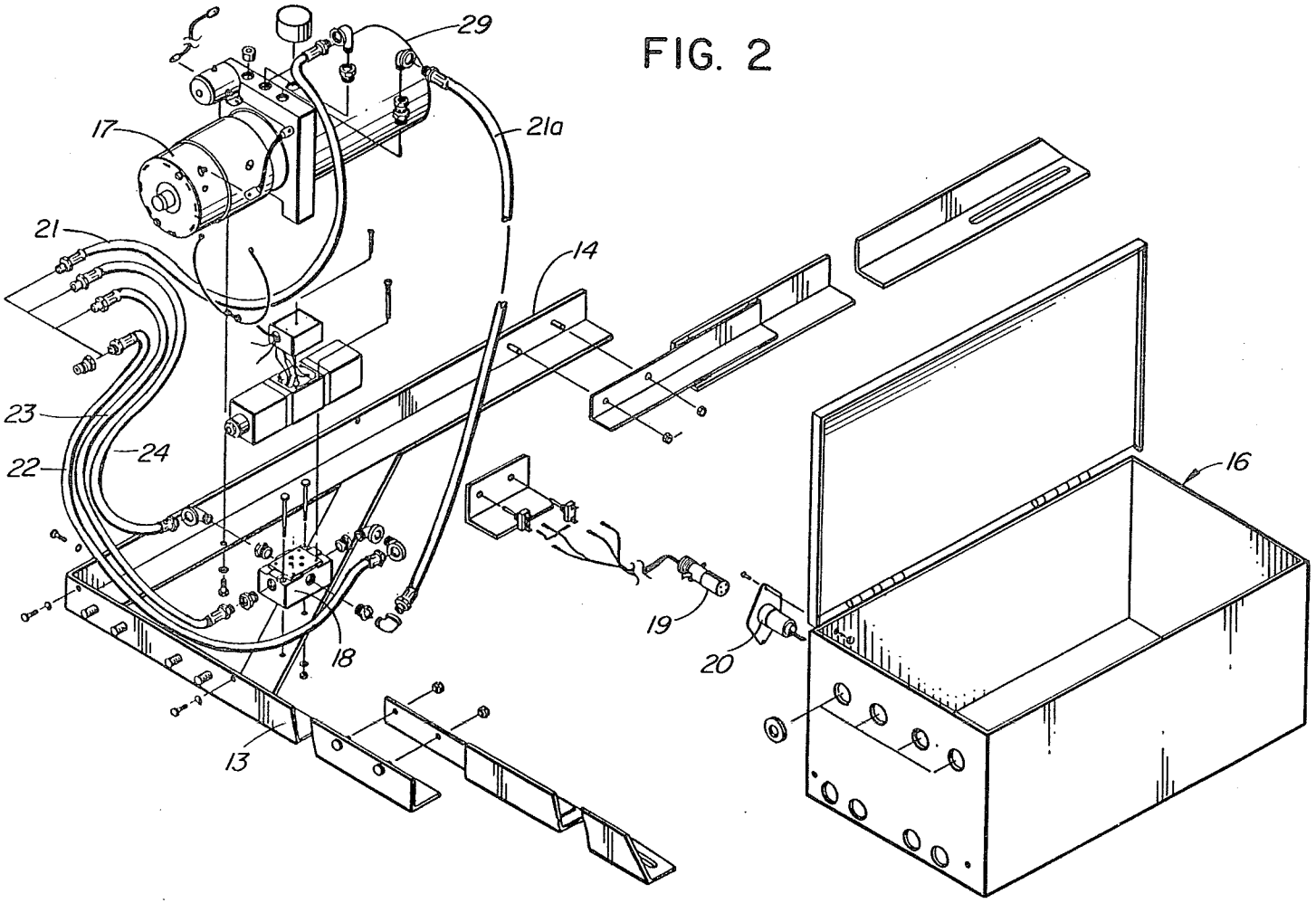
FIG. 2 is an exploded perspective view of the mounting frame and hydraulic power system of the aspect of the invention shown in FIG. 1.

As seen in FIGS. 1 and 2, the soil sampling device 10 is mounted on a pick-up truck 11 by means of a universal mounting 12 constituted by a pair of angle arms rigidly secured at a right angle to one another with one arm 13 extending along the longitudinal length of the bed of the truck, and a second arm 14 extending along the transverse width of the bed of the truck, with the angle arms being attached by bolts (unnumbered) to the existing stake pockets of the pick-up truck. Secured to the universal mounting is a power box 16 containing therein an electrically powered motor 17 to provide hydraulic fluid under pressure. The electrical connection to the power box is in the form of a control box system 18, onto which the operating controls are attached, the actual connection being by means of a female plug 19/male plug 20 connection. Suitable wires 22, 23, and 24 from a 12 volt battery (not shown) to the control box 18 and wire 21 from the battery (not shown) to the motor 17, and wire **21*a* between the control box 18 and the motor 17** are also shown.

Figure 4:
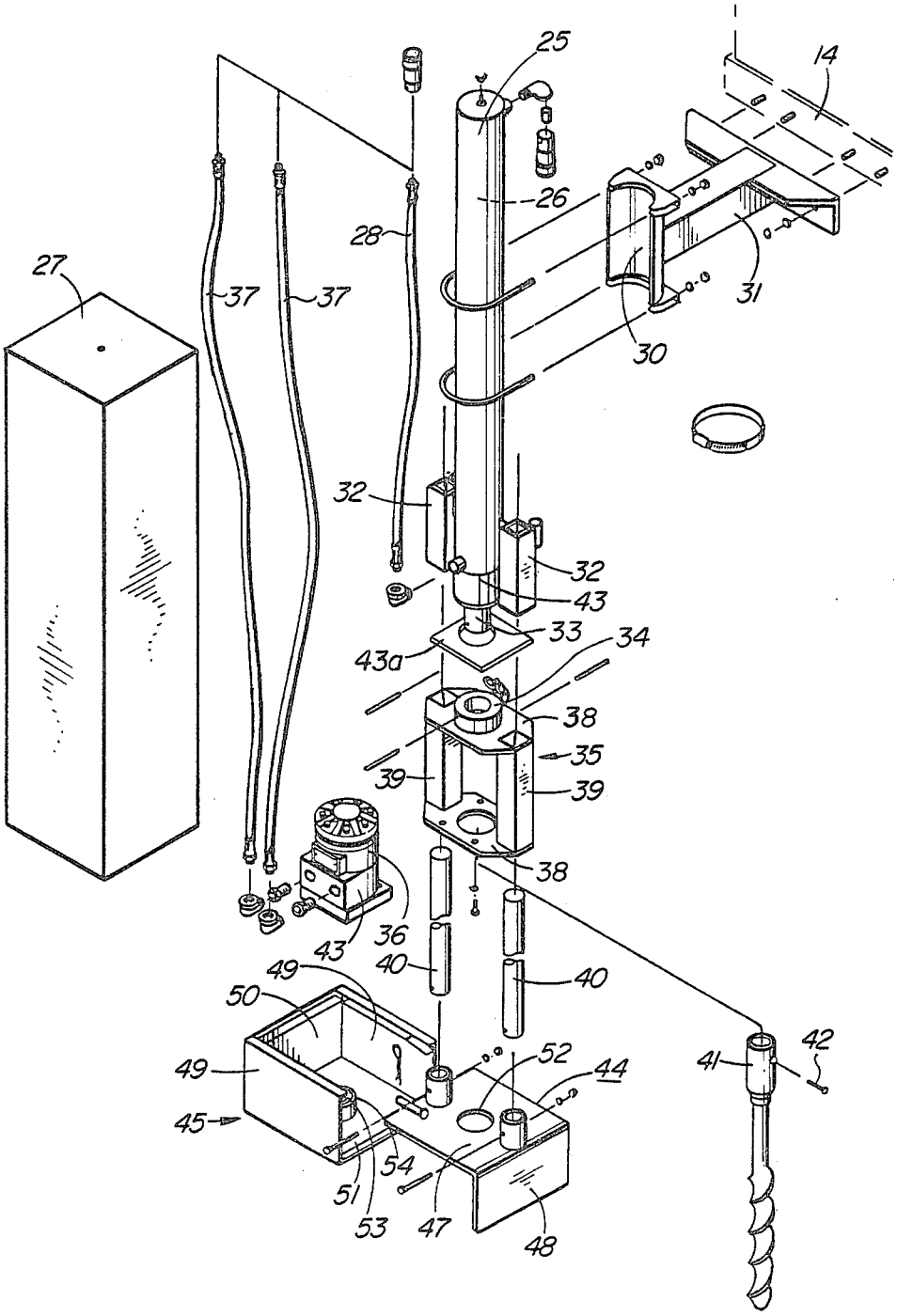
FIG. 4 is an exploded perspective view of the drill drive and soil collection assembly of the aspect of the invention shown in FIG. 1.

As seen in FIG. 4, secured to the universal mounting 12 is the casing 25 of an an hydraulic cylinder 26, sheathed by a protective box 27. The securement is by means of a saddle 30 secured by a T-bar 31 to the arm 14. A suitable hydraulic line 28 extends between the hydraulic fluid motor 29 and the interior of the hydraulic cylinder 26. The lower end of the casing 25 of the hydraulic cylinder 26 is also provided with a pair of spaced-apart fixed hollow rectangular guide sleeves 32.

The free rod end 33 of the hydraulic cylinder 26 is secured to a collar 34 of an open cage 35, within which is secured an an hydraulically powered rotary motor 36, which motor is provided with a pair of hydraulic feed lines 37. The cage 35, includes upper and lower plates 38 interconnecting a pair of hollow rectangular guide rods 39 slidable along guide rods 40, whereby the motor 36 is vertically slidable along the guide rods 40. The motor 36 drives an auger 41 which is threaded to the drive shaft (not shown) of the motor 36 to provide a positive yet easily changed connection. If desired, the auger 41 may be mounted by means of a safety shear pin 42 to minimize auger damage.

Thus, the auger 41 is rotatably driven (by the motor 36) as well as being vertically oscillatable by the rod 33 of the hydraulic cylinder 26.

A yoke **43*a* is also secured to the rod 33 of the hydraulic cylinder 26 an adjustable preselected distance, e.g. about 8" above the collar 34. Yoke 43*a* is secured to rods 40 which are in turn secured to the fixed portion 44 of the soil sample box 45. Yoke 43*a* and rods 40 are mounted to slide with respect to guide sleeves 32 between an upper limit, where the yoke 43*a* abuts the end of casing 25 of hydraulic cylinder 26, and a lower limit, where the soil sample box rests atop the soil. Thus, the hydraulic cylinder rod 33 provides vertical oscillation of the soil sample box 45** as well.

The soil sample box 45 includes a fixed portion 44 including a top wall 47 and a front wall 48. A removable portion of the sample box is provided which includes a pair of side walls 49, a rear wall 50 and a bottom wall 51. The top wall 47 and bottom wall 51 are provided with aligned apertures 52, 53 to accommodate the auger. Aperture 53 is surrounded by cylinder 54.

Figure 5:
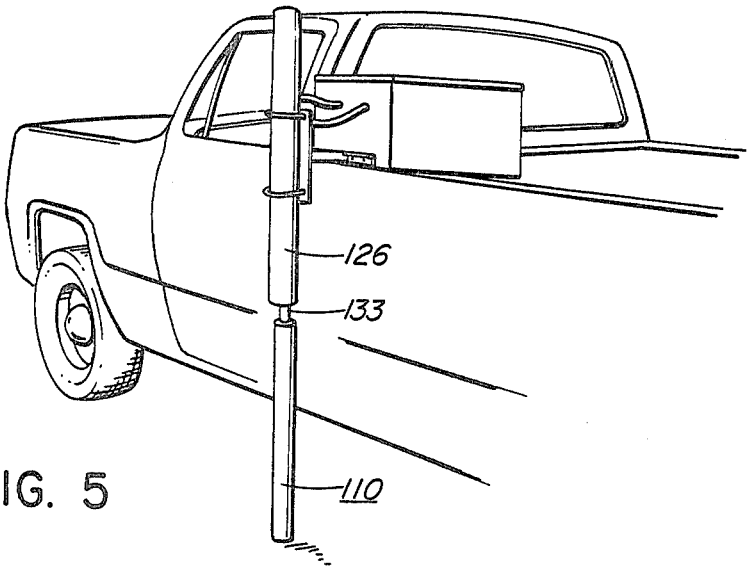
FIG. 5 is a perspective view of the soil sampling device of another aspect of this invention.
Figure 6:
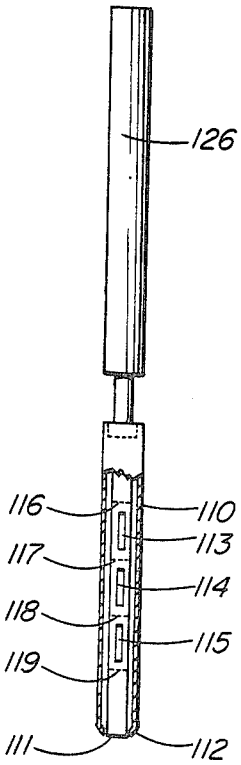
FIG. 6 is a vertical cross-section of the soil sampling device of another aspect of this invention.

(Description of FIGS. 5 and 6)

The embodiment of FIGS. 5 and 6 includes the same mounting frame and hydraulic system as that of FIGS. 1–4. The bottom portion includes a probe tube 110 secured to the free rod end 133 of the hydraulic cylinder 126. The probe tube 110 includes a mouth 111 at the end of a slightly frusto-conical tip 112 so that the diameter of the core sample is less than the diameter of the probe tube 110. The probe tube 110 is provided with three spaced-apart, vertical, soil removal slots 113, 114, 115, each provided selectively with a hand-operated baffle 116, 117, 118. The upper such slot 113 is provided with such lower baffle 118; the mid such slot 114 is provided with upper 116 and lower 118 such baffles; and the lower such slot 115 is provided with an upper such baffle 117.

OPERATION OF PREFERRED EMBODIMENTS

Operation of Embodiments of FIGS. 1–4

In use, when the hydraulic power is supplied to the hydraulic cylinder 26 and the rotary motor 36, the orbit motor 36 is operated and the auger 41 is rotated while the auger 41 is above the top of the soil sample box 45. Activation of the hydraulic cylinder 26 provides a co-operative vertical movement and forces the soil sample box 45 to the ground level and at the same time forces the auger 41 through the soil sample box to the preselected designated depth (i.e., 8″) into the soil which is equal to the adjustable spacing between the yoke 43*a* and the collar 34. The rotation of the auger 41 provides a self-feeding of the sample into the soil sample box 45. This generally takes less than 30 seconds.

The hydraulic cylinder 26 is activated in the reverse direction to raise the auger 41 and the soil sample box 45 above the ground. In this position, the soil sample box 45 is approximately 16″ above the ground. The soil samples may now be taken from the soil sample box by withdrawing the removable portion.

Operation of Embodiment of FIGS. 5 and 6

In use, activation of the hydraulic cylinder forces the probe tube a selected distance into the ground. Withdrawal of the probe tube brings with it an undisturbed core of soil sample. The upper, mid and/or lower states of the core can be separately removed through use of the slots and hand-operated baffles.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

I claim:

1. A soil sample device comprising:

(a) an upper hydraulic cylinder provided with a casing and a rod movable from said casing, the casing thereof being anchored;

(b) a rotary motor fixedly mounted at the end of said rod of said hydraulic cylinder and adapted for vertical movement relative to said anchored casing of said hydraulic cylinder together with said rod of said hydraulic cylinder;

(c) an auger secured to, and rotatably driven by, said motor, said motor and auger being cooperatively vertically movable by said rod between an inoperative position, in which said auger is out of contact with the soil, and an operative position, in which said auger passes through, and a predetermined distance into, the soil;

(d) a lower soil sample box positioned below said motor and mounted to said rod of said hydraulic cylinder at a location above said rotary motor for vertical movement with respect to said anchored casing of said hydraulic cylinder, said soil sample box including a pair of vertically aligned apertures therethrough for the passage of said auger therethrough, said soil sample box being thus vertically movable between a rest position out of contact with the soil and an operative position positioned atop the soil; and (e) guide means to guide said rotary motor and said auger, for said vertical movement.

2. The soil sampling device of claim 1 wherein said soil sample box includes a fixed component comprising a top wall and a front wall secured to said guide means, and a removable component including a bottom wall, two opposed side walls and a rear wall, for selective removal from said fixed component when said soil sample box contains soil sample, and when said auger is in its inoperative position.

3. The soil sample device of claim 2 wherein said bottom wall includes a bottom aperture surrounded by a cylinder, whereby to retain soil sample in said box.

4. The soil sample device of claim 1 wherein said casing of said hydraulic cylinder is also provided with a pair of lower, spaced-apart, fixed guide rods.

5. The soil sample device of claim 4 wherein said rotary motor is provided with a casing, said casing being captured within a cage having hollow guide tubes encasing said guide rods.

6. The soil sample device of claim 5 wherein said soil sample box is secured a fixed distance below said cage to upstanding rods, each of which being secured, at its upper end to a yoke which itself is secured to said rod of said hydraulic cylinder a predetermined fixed distance above said cage.

7. The soil sample device of claim 6 wherein said upstanding rods are slidable within guide sleeves secured to said casing of said hydraulic cylinder.

8. The soil sample device of claim 1 wherein said auger is pinned to said drive shaft by at least one shear pin.

9. The soil sample device of claim 1 mounted on a pick-up truck by means of a universal mounting comprising:

(i) a first arm extending along the longitudinal length of the bed of said truck;

and (ii) a second arm extending along the transverse width of the bed of said truck.

10. The soil sample device of claim 9 wherein said arms are angle irons.

* * * * *